US010758439B1

(12) United States Patent
Lake

(10) Patent No.: US 10,758,439 B1
(45) Date of Patent: Sep. 1, 2020

(54) ELECTRIC POWERED SEAT LIFT CHAIR

(71) Applicant: Eustace Roger Lake, Treasure Island, FL (US)

(72) Inventor: Eustace Roger Lake, Treasure Island, FL (US)

( * ) Notice: Subject to any disclaimer, the term of this patent is extended or adjusted under 35 U.S.C. 154(b) by 0 days.

(21) Appl. No.: 16/501,891

(22) Filed: Jul. 1, 2019

(51) Int. Cl.
*A61G 5/14* (2006.01)
*A47C 7/58* (2006.01)
*A47C 31/00* (2006.01)

(52) U.S. Cl.
CPC ..... *A61G 5/14* (2013.01); *A47C 7/58* (2013.01); *A47C 31/008* (2013.01)

(58) Field of Classification Search
None
See application file for complete search history.

(56) References Cited

U.S. PATENT DOCUMENTS 5,011,224 A * 4/1991 Paul ..... A61G 5/14 297/339
5,058,912 A * 10/1991 Harroun ..... A61H 3/04 135/67
5,094,508 A * 3/1992 Bathrick ..... A61G 5/14 297/320
5,588,162 A * 12/1996 Robinson ..... A61G 7/1017 4/667
7,722,119 B1 * 5/2010 Delmestri ..... A47C 9/002 297/313
2006/0238007 A1 * 10/2006 Lin ..... A61G 5/14 297/330
2010/0207353 A1 * 8/2010 Hsu ..... A61G 5/14 280/304.1
2016/0206098 A1 * 7/2016 Rivera ..... A47C 1/03294
2019/0125601 A1 * 5/2019 Hector ..... A61G 7/1034

FOREIGN PATENT DOCUMENTS

CA 2089057 A1 * 8/1994 ..... A61G 5/14

* cited by examiner

*Primary Examiner* — David E Allred

(57) ABSTRACT

A chair equipped with a pendant controller to help a person rise from a setting position to a standing position with the assistance of arm rests for stability. The chair allows the rear of the seat to be lifted by an electric lifting device mounted directly under the rear of the seat. The front of the seat is hinged to the front frame of the chair allowing the rear of the seat to be moved up to allow the user to reach a height that allows them to exit the chair. The arm rest allows the person to maintain stability during the process.

5 Claims, 3 Drawing Sheets

ELECTRIC POWERED SEAT LIFT CHAIR

FIELD OF INVENTION

The invention is designed to help a person that has some difficulty standing from a sitting position in a chair without assistances.

BACKGROUND

When looking for a powered chair to assist a person who requires help to stand from a sitting position to a standing position. The chairs I found the whole chair would move up from the rear and forward at an angle. When the person is in a standing position the arm rest had moved lower to the point the person had nothing to steady themselves with. As the seat moved upward and forward the arm rest move down at an angle to a point the person could not use them to support themselves when standing.

This invention differs as only the rear of the seat moves in an upward position leaving the arm rest in is normal position and available for the person to hold onto and steady themselves as they reach a standing position.

SUMMARY

This Invention provides a different approach in helping those that have a difficult time standing from a sitting position in a chair This invention allows only the rear portion of the seat to be moved in an upward motion as the front of the seat is hinged to the front of the chair frame and remains in that position. By this method the arm rest remain in the same position as the front of the seat allowing the person to steady themselves while attaining a standing position.

BRIEF DESCRIPTION OF THE DRAWINGS

The following FIGS. 1, 2, and 3 of the drawings will point out the main features of this invention, but do not limit the exact location of these features.

The numbers on FIG. 3 will be used in the Detailed Description to point out the described features herein.

1. Pendant control that operates the electrics for the lifting device, it can be mounted on the arm rest or be hand held.
2. Shows the arm rest that extends from the front most of the chair to the rear of the chair it can be attached to the front seat frame of the chair and to the back of the chair either to the seat frame or chair leg or any appropriate place on the chair that will support at least 400 lbs.
3. Hinge

FIG. 3—shows a view of all features and what the seat looks like in the up position

DETAILED DESCRIPTION

In accordance with a method a standard chair such as one having arm rests on each side may be modified. The seat may be removed such as by removing screws that attach the seat to the chair frame. A hinge may be attached to both the front bottom of the seat and to the front frame support of the chair. The hinge may be, for example, an 8 inch hinge with one side of the hinge attached to the front bottom of the seat and the other side of the hinge attached to the front frame support of the chair so that the cushion may be lifted from the rear but remain attached to the front chair support with the hinge to allow movement.

Figure 1:
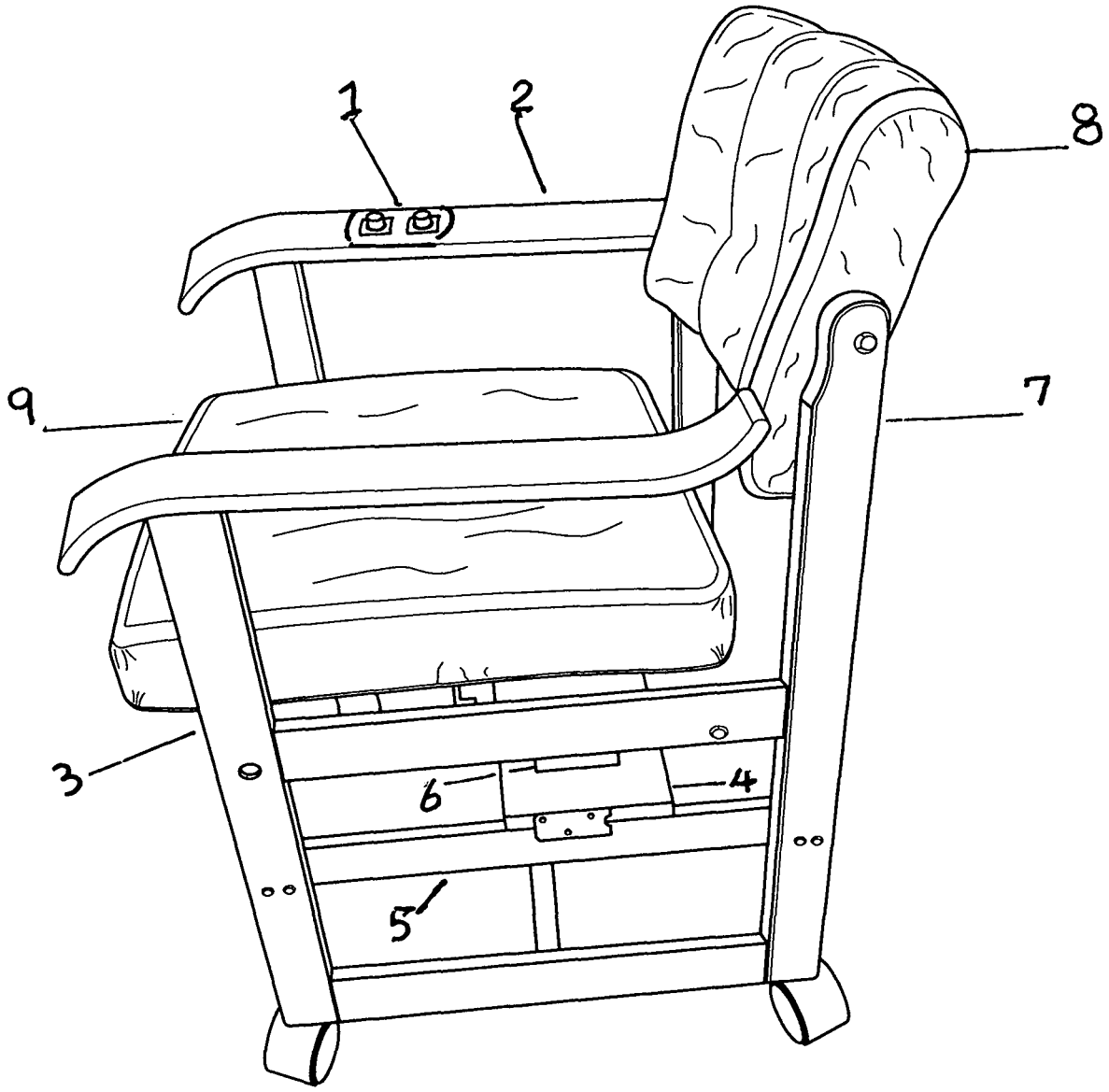
FIG. 1—Number 1 depicts an example view of the pendant control that operates the controls on the electric powered lifting device. The pendant control can be mounted to the chair or can be hand held.
Figure 2:
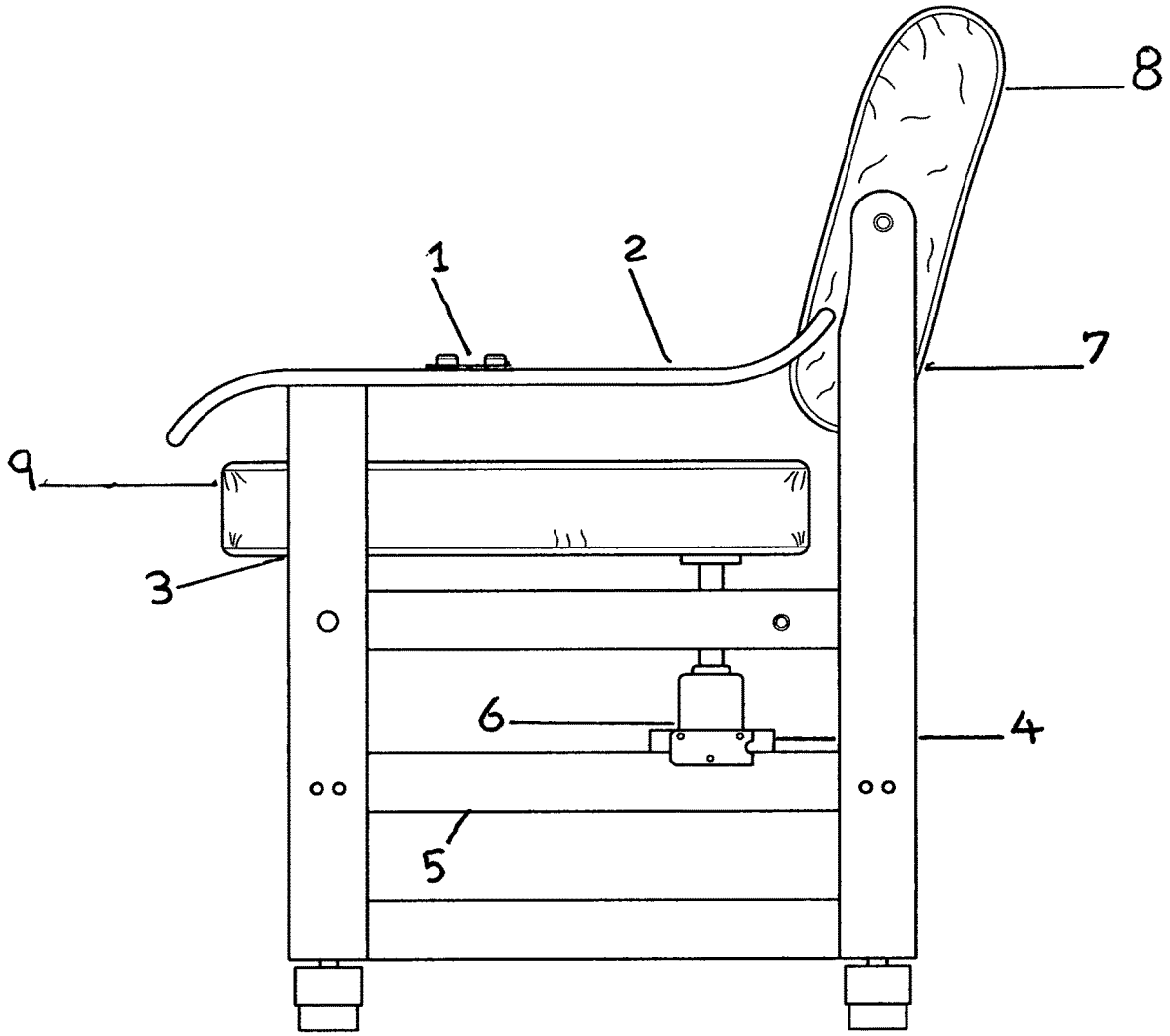
FIG. 2—All the numbers are displayed as a general view of the Electric Power lift seat chair.
Figure 3:
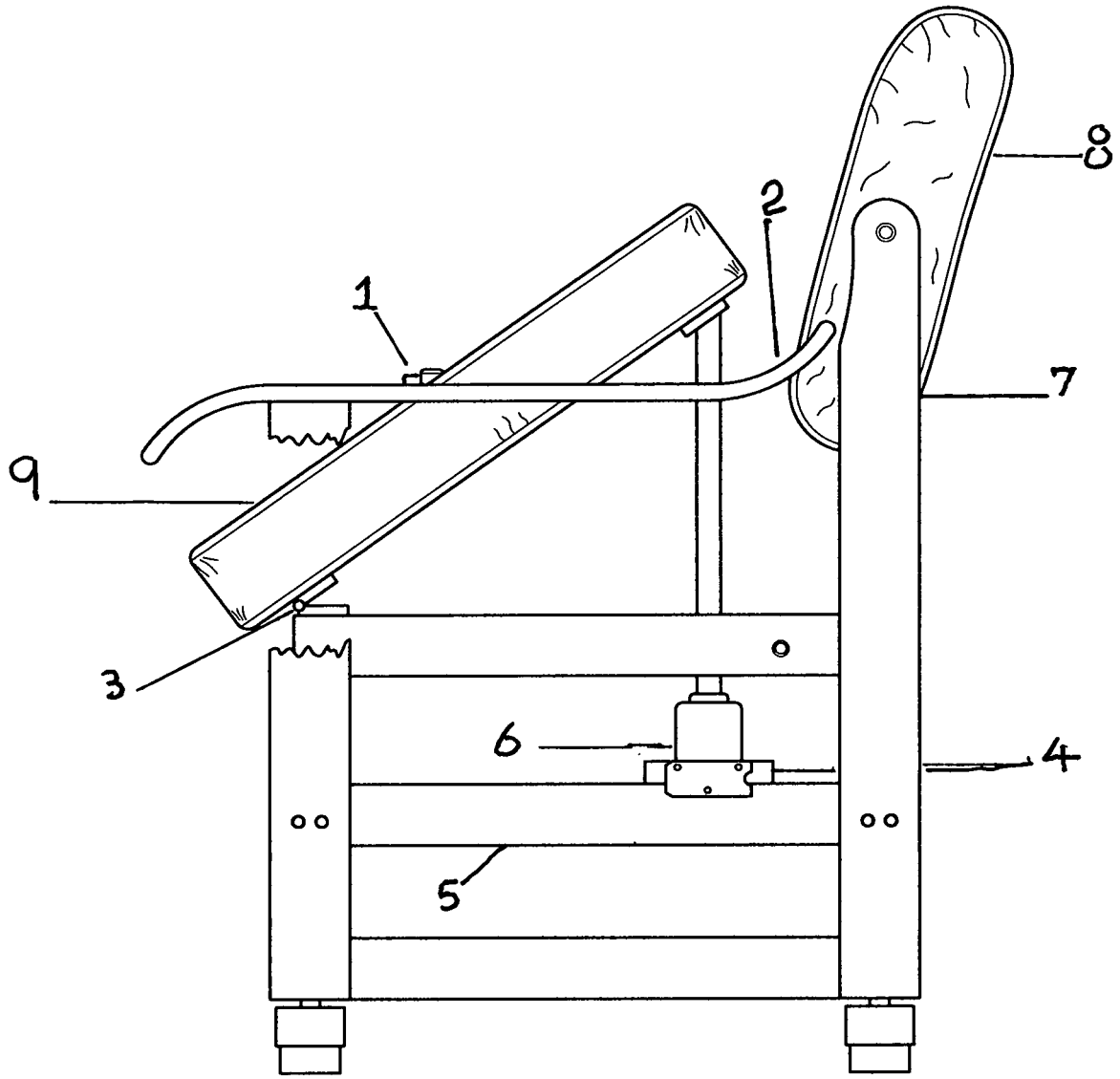
FIG. 3 shows the view and location of the hinge. It attaches to the top front of the seat frame and the bottom front of the seat.
4. Shows the platform that the lifting device sets on under the back of the chair seat.
5. Shows the brace that supports the platform.
6. The electric powered lift and electrics seen best on FIG. 3.
7. Chair back
8. The chair
9. The seat Some embodiments of this invention are illustrated as an example but are not limited by the figures in the drawings.

The numbers on the drawing in FIG. 2, included within brackets, are to be used to identify the area being discussed at the beginning of each main feature in the description. This allows the reader to view the drawing and identify each area they are reading.

(5) The electric powered seat lift source shall be mounted on supports built onto the chair. For example, a hard wood brace may be added to each side of the chair between the front and rear legs at a height that allows for the lifting device to be installed under the seat. A platform may be placed under the seat and resting on the two hard wood braces to support the lifting device. The supports shall be attached on both sides from the front leg of the chair to the rear leg of the chair. A platform shall be mounted between the two supports to a position and height that will allow the lifting device to be positioned directly beneath and toward the rear of the seat. The lifting device may include a 12 v DC motor. The lifting device can be scissor, liner actuator, air, hydraulic or any lift.

(6) An electric power source for the lift motor and electrics which includes a pendant control to control the rising and lowering of the seat. To make it more versatile a 12 v DC battery may be mounted next to the lift and attached a 12 v DC charger with a 120 v AC input. When required the charger can recharge the battery by just plugging into 120 v AC standard electrical receptacle. This allows the use of the chair either close to 120 v AC outlets or in an area that 120 v AC is not readily available.

(9) The bottom front of the seat is attached to the front top of the chair frame that supports the seat with a hinge.

(3) The hinge is mounted to the top front of the chair frame that the seat rests on with screws or other methods of attaching it. The other side of the hinge is mounted to the bottom front of the seat. Thus allowing the seat to be lifted from the back but staying attached in the front with a hinging action (2) The two arm rests can be fabricated from wood or any other material that can extend to the front most of the chair, one attached on the right side and one attached to the left side of the chair frame that supports the seat. The arm rests are to be stationary in order to help the occupant stabilize his or herself while standing up.

(1) The pendant which controls the electrics to the motor shall have an up function switch and a down function switch that moves the seat upward and downward. The pendant can be mounted to the chair or hand held. The pendant enables the occupant to control up and down movement of the rear of the seat to put as much lift on the rear of the seat tilting the seat at an angle that best enables the occupant to exit the chair.

The invention claimed is:

1. A chair comprising:

a chair frame having first and second front legs and first and second rear legs;

a first upper frame member and a first lower frame member each interconnecting the first front leg and the first rear leg and a second upper frame member and a second lower frame member each interconnecting the second front leg and the second rear leg;

a seat bottom, including a front portion and a rear portion, the front portion hingedly connected at a front end of the chair frame, the seat bottom positioned proximate to the first and second upper frame members in a lowered sitting position;

a first brace interconnecting the first front leg and the first rear leg at a position between the first upper frame member and the first lower frame member and a second brace interconnecting the second front leg and the second rear leg at a position between the second upper frame member and the second lower frame member;

a platform interconnecting the first brace and the second brace in a rear half of each of the first and second braces;

an electric powered lift mounted on the platform and movably connected to an underside of the rear portion of the seat bottom, the electric powered lift configured to raise the rear portion and tilt the seat bottom about the hinge in a raised arise assist position.

2. The chair of claim 1, further comprising a first armrest supported at least in part on the first front leg and a second armrest supported at least in part on the second front leg.

3. The chair of claim 2, wherein each of the first and second armrests is rigidly connected to respective first and second upward extensions of the first and second front legs.

4. The chair of claim 1, further comprising a chair back including a backrest supported on an upward extension of each of the first rear leg and the second rear leg.

5. The chair of claim 1, further comprising a control for actuating the electric powered lift in upward or downward directions.

* * * * *